US005230907A

United States Patent [19]

Strickland

[11] Patent Number: 5,230,907

[45] Date of Patent: Jul. 27, 1993

[54] INSIDE CORNER FORM

[75] Inventor: James Strickland, Jacksonville, Fla.

[73] Assignee: Strickland Industries, Inc., Jacksonville, Fla.

[21] Appl. No.: 700,710

[22] Filed: May 16, 1991

[51] Int. Cl.[5] ..... B28B 7/30

[52] U.S. Cl. ..... 425/107; 425/438; 425/441; 249/161; 249/165; 249/180; 249/184; 249/194

[58] Field of Search ..... 249/18, 26, 27, 161, 249/184, 186, 185, 194, 178, 157, 219.1, 165; 425/438, 441, 442, 107; 74/587, 605; 403/388, 408.1

[56] References Cited

U.S. PATENT DOCUMENTS

| | | | |
|---|---|---|---|
| 2,827,683 | 3/1958 | Bernart et al. | 249/180 |
| 3,476,351 | 3/1958 | Burdett et al. | 249/82 |
| 3,570,802 | 3/1971 | Miller | 249/179 |
| 3,841,596 | 10/1974 | Cull | 249/20 |
| 3,844,526 | 10/1974 | McCracken | 249/152 |
| 3,853,452 | 12/1974 | Del Monte | 425/450 R |
| 3,934,808 | 1/1976 | Alzawa | 240/27 |
| 3,989,439 | 11/1976 | Schmitzberger | 425/392 |
| 4,088,296 | 2/1978 | Armas | 249/180 |
| 4,252,291 | 2/1981 | Armas | 249/27 |
| 4,447,035 | 2/1984 | Ivey et al. | 249/194 |
| 4,570,896 | 2/1990 | Strickland et al. | 249/27 |
| 4,614,326 | 9/1986 | Strickland et al. | 249/27 |
| 4,664,173 | 5/1987 | Wolniak | 425/107 |
| 4,729,541 | 3/1988 | Maier | 249/194 |
| 4,890,999 | 1/1990 | Del Monte | 425/439 |
| 5,058,855 | 10/1991 | Ward | 249/219.1 |

FOREIGN PATENT DOCUMENTS

| | | |
|---|---|---|
| 382606 | 12/1906 | France . |
| 1436683 | 3/1965 | France . |
| 2059864 | 7/1970 | France . |

*Primary Examiner*—Jay H. Woo
*Assistant Examiner*—Khank Nguyen
*Attorney, Agent, or Firm*—Banner, Birch, McKie & Becker

[57] ABSTRACT

An inside corner form for forming an inside corner of a wall structure for casting concrete includes a central member for forming the corner, side members for forming portions of the walls adjacent the corner, an actuator for expanding and contracting the inside corner form and a lid for five sided pours. Slide lugs are provided to engage the central and side members such that the members are maintained in their proper orientations, while still permitting the members to slide relative to one another during the expansion and contraction of the form. A flowable material is injected between the central and side members for lubrication and to form a barrier to prevent grout from seeping between the members of the inside corner form and lid.

42 Claims, 6 Drawing Sheets

26
24b
151
149
54
30
40
72
64
70
58
63
60
62
50
44
37
139
143
76'
119
113
104
108
102
133
132
100
137
131
72'
52
42
38
66
89
73
155
68
28
92
48
46
129
106
127
135
108
113
104
119
76'
72'
66
89
42
52
40
73
68
38
28
60
94
62
C
A
36
34
32
141
37
44
50
56
155
63
58
30
70
72
54
64
149
151
24a
D
B

26

173
151
119
76'
104
108
102
131
100
137
132
149
30
28
72'
113
133
64
72
7
106
129
70
89
66
135
108
94
73
113
104
119
62
68
89
76'
72'
173
92
7
66
28
50
155
127
70
73
68
151
155
30
149
143
94
72
139
36
34
32
141
37
92
50
62
64
A
C
B
D

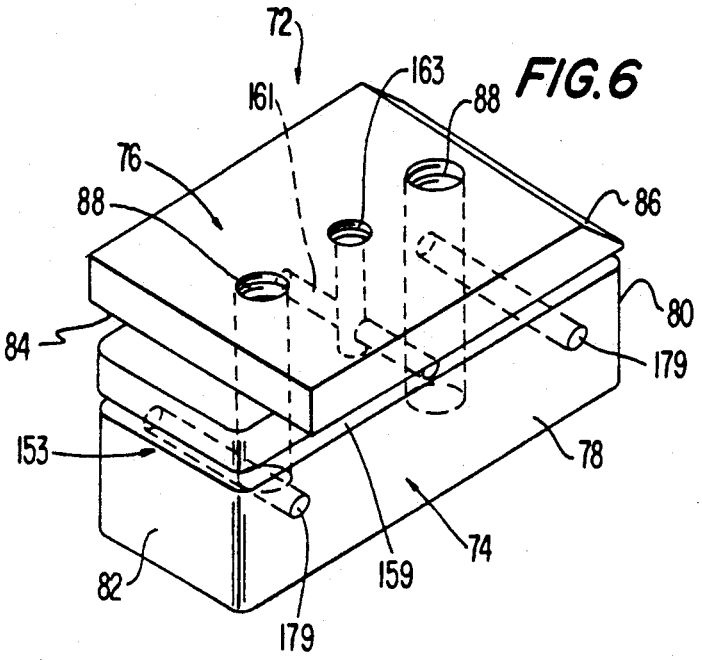
FIG. 6
FIG. 7
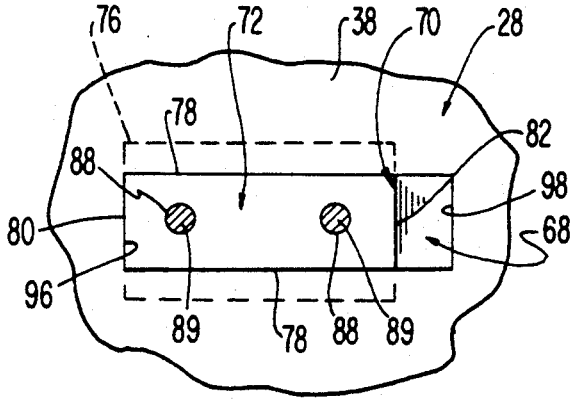
FIG. 8
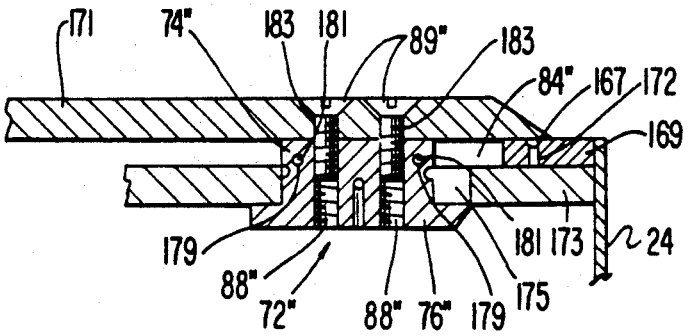

INSIDE CORNER FORM

FIELD OF INVENTION

The present invention pertains to a form for the fabrication of a concrete structure, and in particular, to a form designed to shape the inside corner of a concrete wall structure.

BACKGROUND OF THE INVENTION

Inside corner forms are used to form the inside corner of a concrete wall structure. Typically, the inside corner forms are used in the fabrication of tubular concrete structures, such as elevator shafts, stairwells, and box culverts.

To facilitate commercial usage inside corner forms must be easily assembled into place and easily removed from the casting. Further, all of the elements of the form should be interconnected to avoid the risk of losing parts between assemblies. Additionally, the inside corner form should be capable of closely aligning with the remaining portions of the form so that a smooth wall surface is created.

Inside corner forms are often fabricated to expand and contract into and out of the position for casting. This movement is ordinarily accomplished through the use of a screw or fluid operated actuating device. Examples of such forms are disclosed in U.S. Pat. No. 4,447,035 to Ivey et al., entitled "Joining Concrete Form Panels to Cast an Inside Corner Wall Structure" and U.S. Pat. No. 4,570,896 to Strickland et al., entitled "Slide Action Inside Corner Form." However, all such forms heretofore have lacked the desired structural integrity to ensure that the forming elements will be closely aligned with one another to avoid the forming of a rough and unsightly seam in the concrete structure. Further, grout (i.e., a cementitious runoff of excess water, cement, sand, etc.) seeping into and forming on the parts of the form has continued to be a persistent problem. This phenomenon causes the form to resist removal from the casting and requires significant cleaning of the form after each use. Moreover, screw operated forms require more time and effort to assemble and disassemble.

SUMMARY OF THE INVENTION

In accordance with the present invention, an inside corner form having a unique construction is provided to overcome the aforementioned problems.

More specifically, the form is comprised of a series of interconnected components driven by a fluid operator for the requisite expansion and contraction. The moveable elements are coupled together through the use of a novel slide lug which functions to hold the parts in their proper alignment. Moreover, the form defines a lubrication system which not only avoids undue wearing of the components, but also prevents the seepage of grout into the form.

The present form ensures against misalignment of the casting panels and thereby facilitates the casting of a relatively clean and smooth concrete wall structure. Further, the parts are interconnected so that the form is subject to easy assembly and removal as necessary. The unique lubrication system further enhances the use of the form by significantly alleviating the cleaning of the forms between uses, as well as lessening the resistance and wearing that occurs in other devices of the prior art.

These and other objects, advantages, and features of the present invention will be more fully understood and appreciated by reference to the written specification and appended drawings.

BRIEF DESCRIPTION OF THE DRAWINGS

FIG. 6 is a perspective view of a slide lug of the present invention;

FIG. 7 is a cross-sectional view taken along line 7—7 in FIG. 4; and FIG. 8 is a cross-sectional view taken along line 8—8 in FIG. 1.

DETAILED DESCRIPTION OF THE PREFERRED EMBODIMENT

Figure 1:
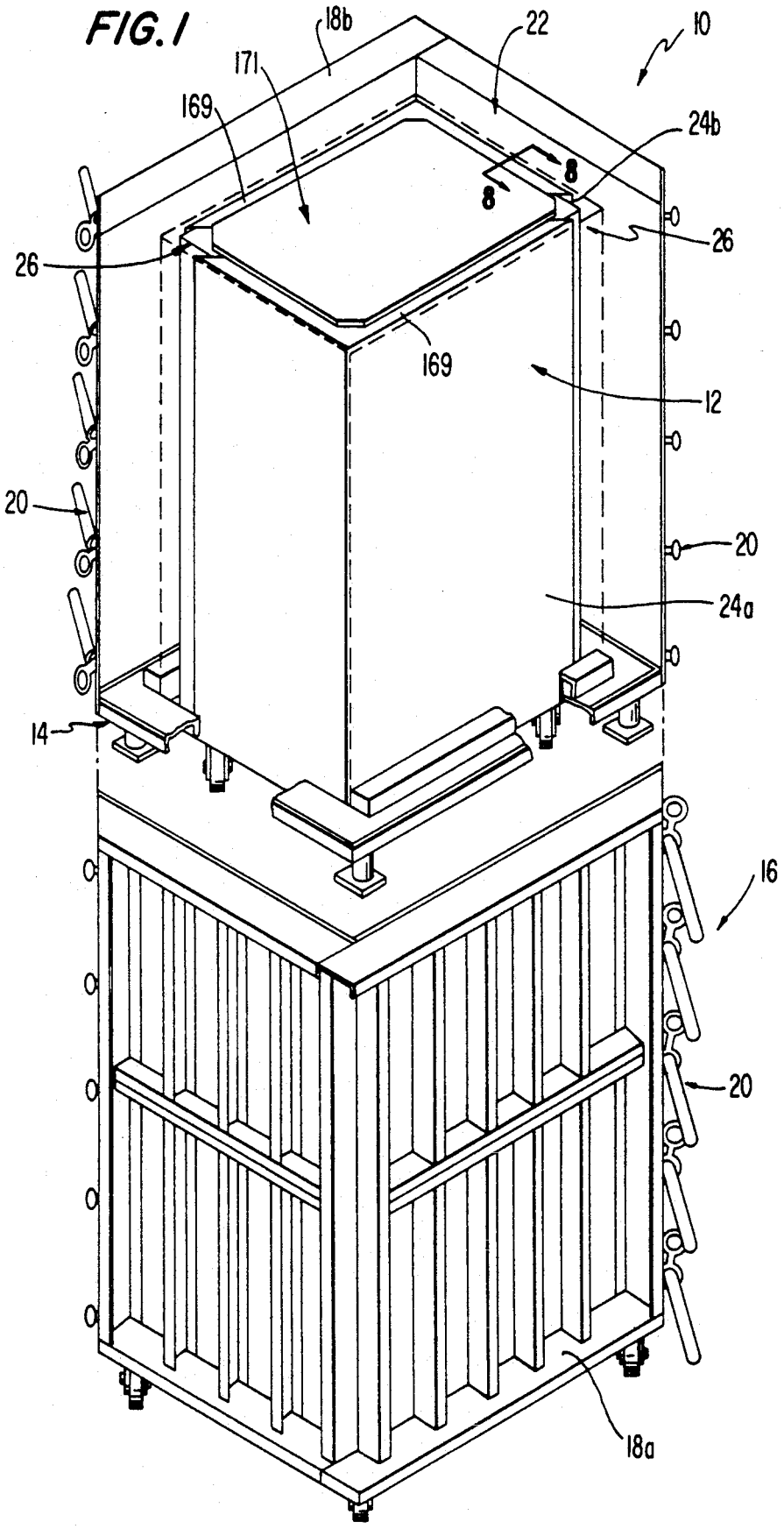
FIG. 1 is an exploded perspective view of an internal and external form of the present invention, with the internal form in its contracted position.
Figure 2:
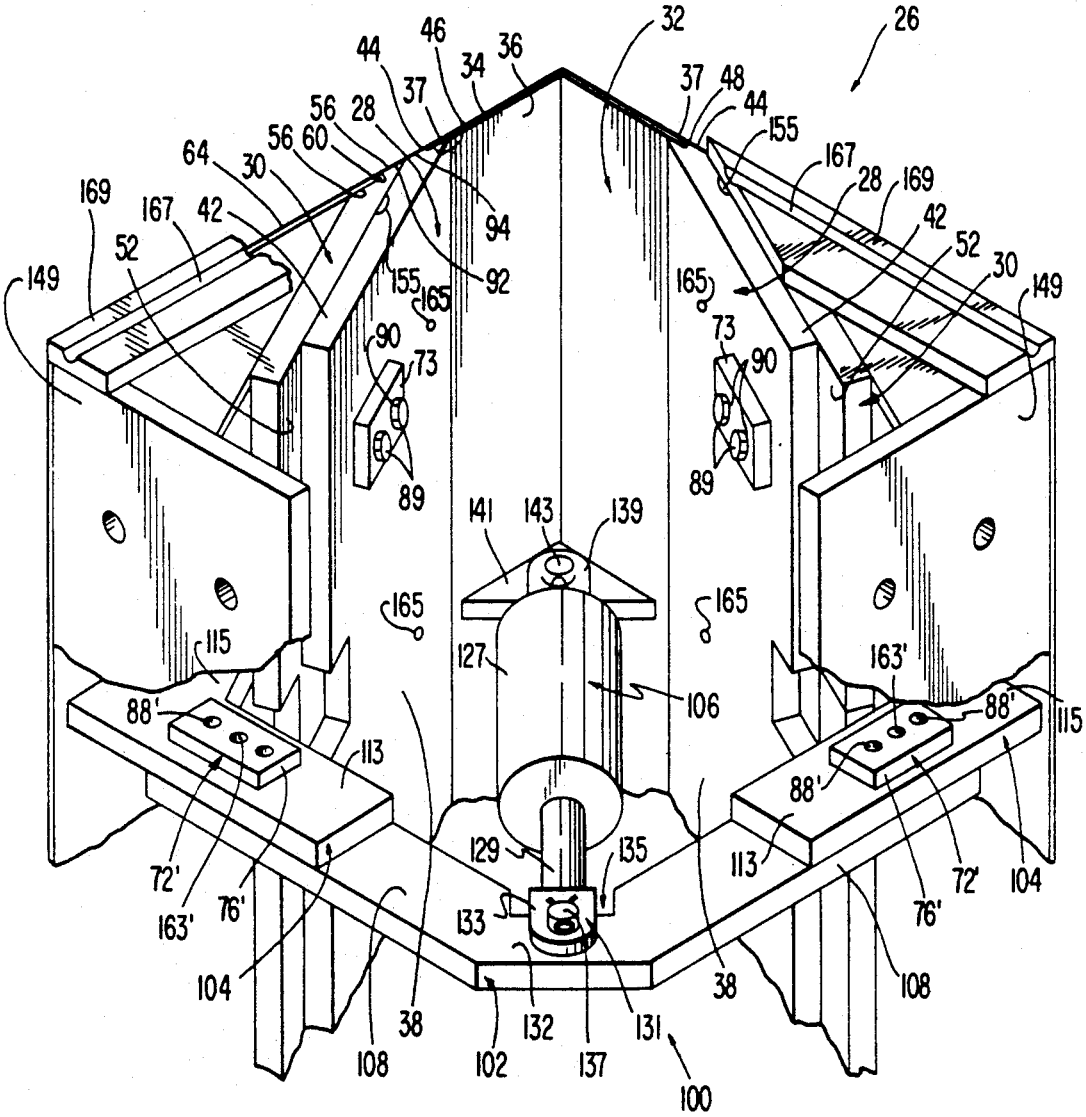
FIG. 2 is a fragmentary, inside perspective view of an inside corner form of the present invention in its expanded position.
Figure 3:
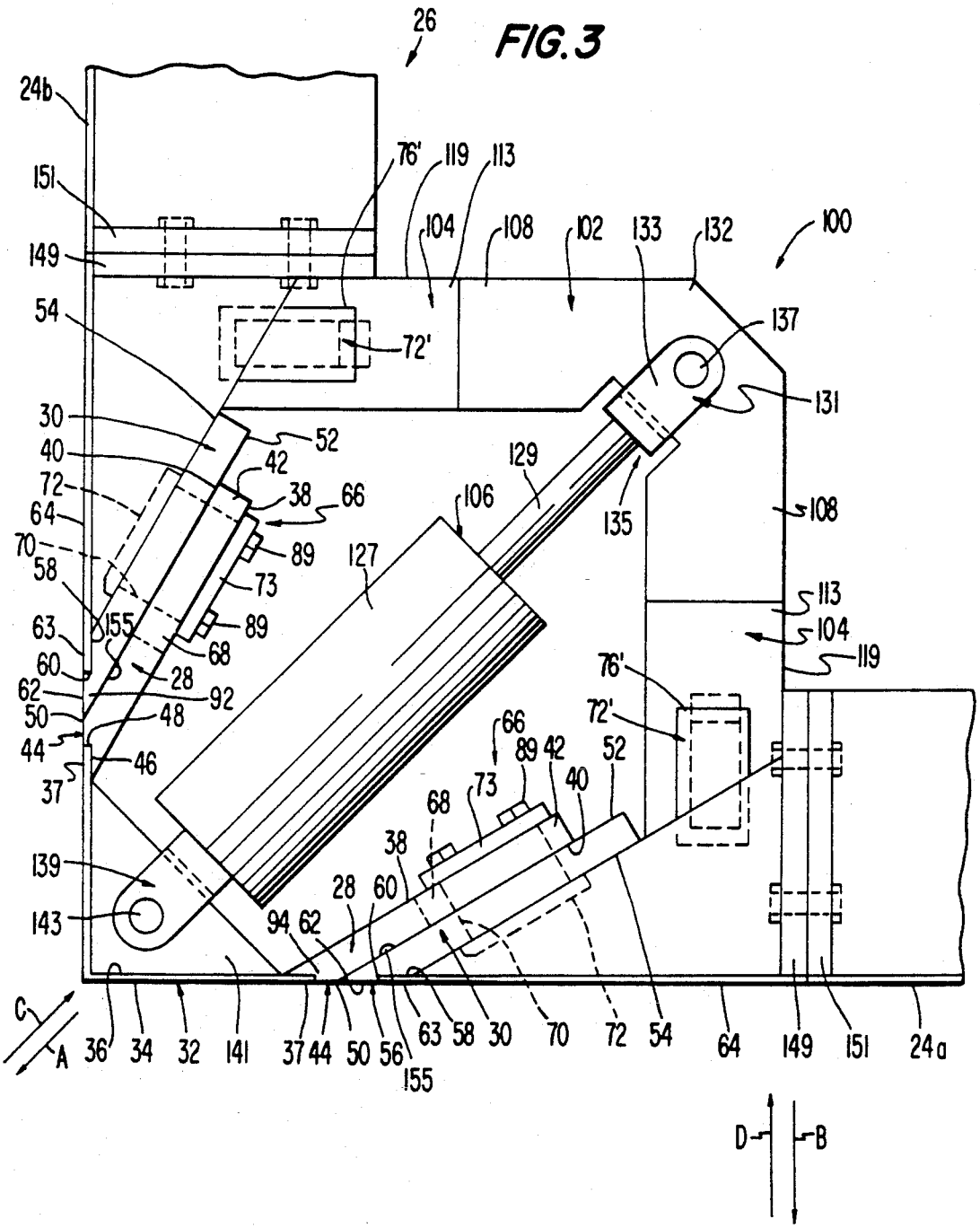
FIG. 3 is a top plan view of the inner corner form in its expanded position.
Figure 4:
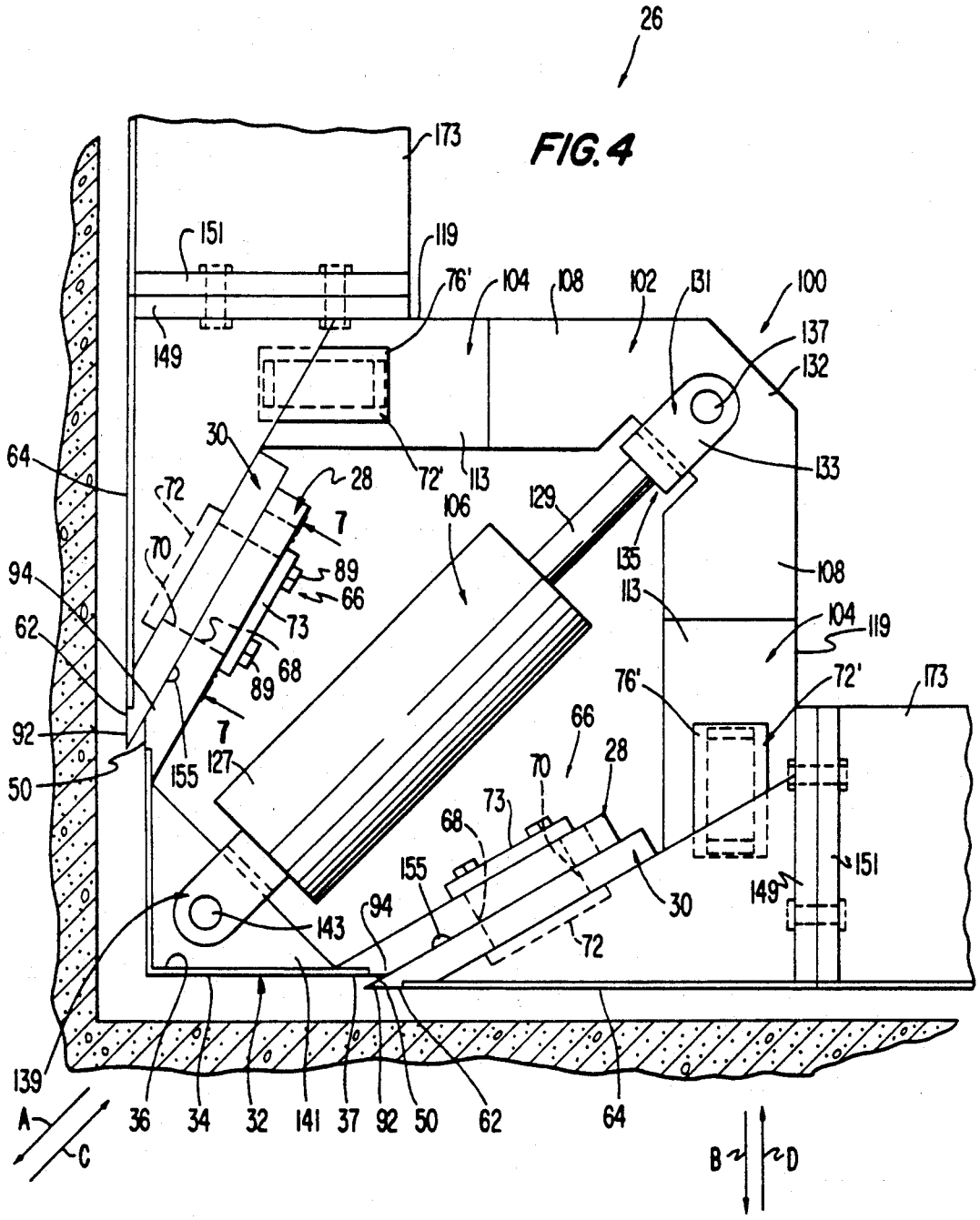
FIG. 4 is a top plan view of the inside corner form in its contracted position.
Figure 5:
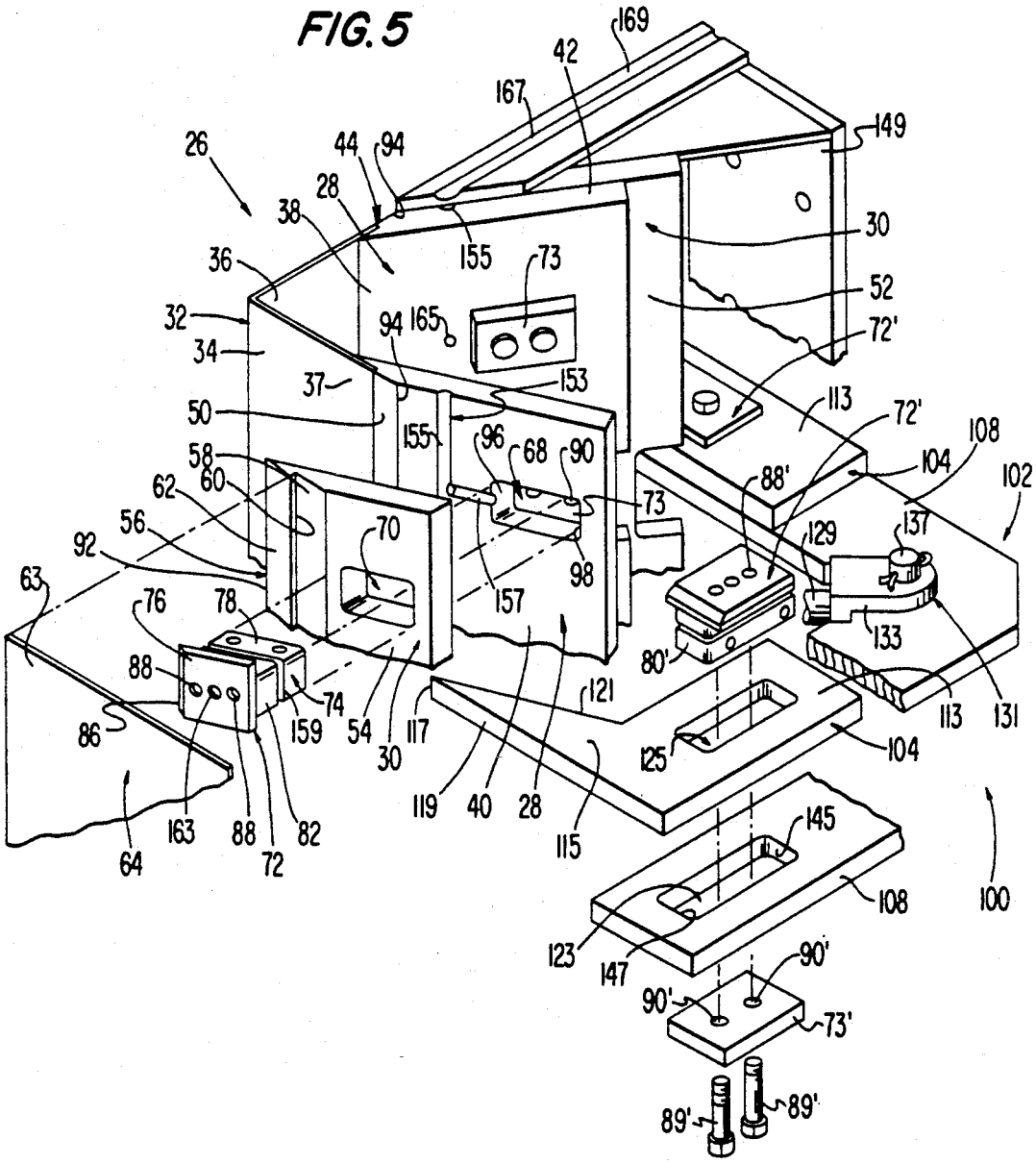
FIG. 5 is an exploded perspective view of the inside form in its expanded position.

In the preferred embodiment, a tubular mold 10 for a concrete casting is defined by an internal form 12, a base 14, and an external form 16. In the illustrated embodiment (FIG. 1), external form 16 is comprised of a pair of L-shaped external form members 18*a*, 18*b*. External form members 18*a*, 18*b* are coupled together at opposing corners by well-known fasteners 20 to define a substantially rectangular opening 22. Internal form 12 is positioned concentrically within opening 22 to define an annular space for the pouring of the concrete. Internal form 12 is comprised of a pair of L-shaped internal forming panels 24 and a pair of inside corner forms 26. Inside corner forms 26 couple forming panels 24*a*, 24*b* at opposing corners for facilitating movement of internal form 12 between a contracted position (shown in full lines in FIG. 1) and an expanded position (shown in phantom in FIG. 1). This unique combination of elements described more fully below facilitate the effective and efficient casting of tubular or five-sided structures.

Each inside corner form 26 (FIGS. 2–5) is comprised of a plurality of slide plates 28, 30 and a V-shaped corner skin plate 32. All of these plates 28, 30, 32 extend the entire height of internal form 12 and cooperatively interact to form the internal wall surfaces at the corners of mold 10.

Corner skin plate 32 is a V-shaped member having an external face 34 and an internal face 36. Corner skin plate 32 can have other configurations if a different internal corner shape is desired. In any event, corner skin plate 32 is fixedly secured along its marginal edges 37 to a pair of spaced apart, converging inner slide plates 28.

Each inner slide plate 28 defines an internal wall 38, an external wall 40, a top edge 42, and a front wall 44. Front wall 44 is preferably oriented an angle of approximately 25° to internal wall 38. In addition, front wall 44 is stepped to define a recessed section 46, a shoulder 48, and a molding face 50. Recessed section 46 is adapted to receive marginal edges 37 of corner skin plate 32.

Shoulder 48 is dimensioned to equal substantially the thickness of corner skin plate 32 so that external face 34 of skin plate 32 is substantially aligned with molding face 50 to form a relatively smooth, clean inner wall surface for the concrete casting. Corner skin plate 32 is preferably welded into place against recessed section 46 of front wall 44. Of course, other securing means could be used.

Each outer slide plate 30 defines an inner wall 52, an outer wall 54, and a front wall 56. Front wall 56 is stepped to include a recessed section 58, a shoulder 60, and a molding face 62. Recessed section 58 and shoulder 60 are adapted to receive the marginal edge 63 of a side skin plate 64. Side skin plate 64 is preferably welded into place; however, other securing means could be used.

When the inside corner form 26 is in its expanded position (FIGS. 2 and 3) and ready to receive the poured concrete, external face 34 of corner skin plate 32, molding face 50 of inner slide plate 28, molding face 62 of outer slide plate 30, and side skin plate 64 are all substantially aligned so that a relatively smooth and clean inner concrete wall surface can be formed. Additionally, side skin plate 64 is substantially aligned with the adjacent internal forming panel 24.

To facilitate the requisite expanding and contracting movements of the inside corner form 26, inner and outer slide plates 28, 30 are structured to slide relative to one another. In particular, inner wall 52 of outer slide plate 30 is in abutting relation with outer wall 40 of inner slide plate 28. The engaged slide plates 28, 30 are coupled together by an assembly 66 which limit the relative sliding movement between the two plates.

The coupling assembly 66 (FIGS. 2–7) includes a substantially rectangular slot 68 defined in internal slide plate 28, a substantially rectangular slot 70 defined in external slide plate 30, a slide lug 72, and a lug retainer 73. Internal slot 68 is slightly longer than external slot 70, so that slide lug 72 is matingly received within slot 70 but loosely received (in a lengthwise dimension only) in slot 68. In contrast, the heights of the slots 68, 70 are the same, so that slide lug 72 is matingly received in both slots with respect to their heights. The complete mating interconnection of slide lug 72 in slot 70 and the mating receipt (in the height dimension) of slide lug 72 in slot 68 securely hold the plates 28, 30 in their proper orientation to ensure that they do not become cocked and out of alignment. Lug retainers 73 function to secure slide lugs 72 in place. Preferably, a pair of slide lugs—one positioned near the top of plates 28, 30 and one positioned near the bottom thereof—are used to couple each pair of adjacent inner and outer slide plates 28, 30. Nonetheless, any number of slide lugs 72 could be used depending upon the length of the plates 28, 30.

Slide lugs 72 (FIGS. 5 and 6) are each comprised of a substantially rectangular body 74 and a head plate 76. Body 74 defines a pair of side walls 78, a front wall 80 and a rear wall 82. Head plate 76 extends beyond side walls 78 and front and rear walls 80, 82 to form a stop for properly positioning body 74 of slide lug 72 in slots 68, 70. More specifically, the inner marginal edge 84 of head plate 76 is adapted to abuttingly engage the outer wall 54 of outer slide plate 30 around slot 70. Head plate 76 is chamfered along its front edge 86 to ensure adequate clearances exist between it and side skin plate 64 during insertion and removal of slide lugs 72 to and from slots 68, 70. Slide lugs 72 are further provided with a pair of longitudinal tapped holes 88 for receiving bolts 89. Bolts 89 extend through apertures 90 in lug retainer 73 and are threadedly secured into holes 88 to securely couple the corresponding slide lugs 72 and retainers 73 together.

When the inner corner form 26 is in its contracted position (FIGS. 1, 4 and 7), the forward apex 92 of outer slide plate 30 is positioned forwardly of corner 94 of inner slide plate 28. Further in this position, body 74 of slide lug 72 is positioned within slot 68 such that front wall 80 is abuttingly engaged with the front face 96 of slot 68. As the inside corner form 26 is expanded (as described below), the inner slide member is driven forwardly relative to the outer slide plate 30 (in the direction of arrow A). During this movement of the inner slide plate 28, slide lug 72 slides through slot 68 until its rear wall 82 engages the rear face 98 of slot 68. In this position, corner 94 has moved into alignment with apex 92 so that the two adjacent molding faces 50, 62 are aligned. Additionally, due to the divergence of inner slide plates 28, outer slide plates 30 are moved outwardly (in the direction of arrow B) with the movement of inner slide plate 28.

When the inner corner form 26 is to be contracted from its expanded position (FIGS. 2 and 3), the inner slide plates 28 are driven rearwardly (in the direction of arrow C). This movement of inner slide plate 28 causes it to slide relative to outer plate 30, because of the elongated dimension of slot 68. This relative sliding movement between the two slide plates 28, 30 continues until body 74 is engaged by the front face 96 of slot 68. Additionally, the movement of inner slide plates 28 will cause outer slide plates 30 to move inward (in the direction of arrow D). This combined movement of the two slide plates 28, 30 continues until the inner corner form has reached its fully contracted position.

At least one driving assembly 100 (FIGS. 2–5) is provided to control and actuate the movement of slide plates 28, 30. Preferably, two driving assemblies will be secured to each set of slide plates 28, 30 with one driving assembly mounted near the top of plates 28, 30 and one positioned near the bottom thereof. Of course, any number of driving assemblies 100 could be used, depending primarily on the height of the slide plates 28, 30.

Each driving assembly includes a squaring arm 102, a pair of brackets 104, a pair of slide lugs 72' (which are identical to slide lug 72), and an actuator 106. Although a fluid actuator is preferred, any linear driving actuator could be used. Squaring arm 102 is a substantially L-shaped member which comprises a pair of orthogonal legs 108. Coupled to the distal end of each leg 108 is a substantially L-shaped bracket 104 having a pair of arms 113, 115. The first arm 113 is substantially rectangular in shape and overlies one of the legs 108 of squaring arm 102. The second arm 115 is substantially triangular in shape and tapers to a distal point 117. The outer edge 119 of bracket 104 engages and secures side skin plate 64 in place. Side skin plate 64 is preferably welded to bracket 104, although other securing arrangements could be used. The inner tapered edge of second arm 115 of bracket 104 is secured to the outer wall 54 of outer slide plate 28. Again, this securing connection is preferably accomplished by welding, but could be achieved by other securing means.

The overlapping portions of bracket 104 and squaring arm 102—namely, first arm 113 of bracket 104 and the distal end of leg 108 of squaring arm 102—are provided with a pair of corresponding slots 123, 125. In the same manner as with slide plates 28, 30 discussed above, slot 123 in squaring arm 102 has the same width as slot 125 in bracket 104, but has a longer length dimension. In this arrangement slide lug 72' is fully matingly received within slot 125 of bracket 104. However, slide lug 72' is matingly received in a width direction with slot 123, but is loosely received in a lengthwise direction. This construction facilitates a limited relative movement in the length direction of slot 123 between bracket 104 and squaring arm 102, but still ensures that a proper orientation of the two components 102, 104 is maintained. In the same manner as with slide plates 28, 30, a lug retainer 73' and bolts 89' are used to hold slide lug 72' in its proper position.

The inside corner form 26 is expanded and contracted by a fluid operator 106. The fluid operator is preferably a hydraulic cylinder 127 having a reciprocating piston (not shown) and piston rod 129. The distal end of piston rod 129 is provided with a clevis 131 which receives the base 132 of squaring arm 102 between a pair of opposed arms 133. Preferably, a recess 135 is provided in squaring arm 102 to facilitate the positioning of clevis 131. In any event, a pivot pin 137 is received through aligned holes to couple clevis 131 to squaring arm 102. In a similar arrangement, the free end of the hydraulic cylinder 127 is also provided with a clevis 139 which receives a forward gusset member 141. Gusset member 141 is generally triangular in shape and welded to interior face 36 of corner skin plate 32. Of course, gusset 141 could have a number of different shapes. In any event, pivot pin 143 is received through aligned holes to couple gusset member 141 and corner skin plate 32 to hydraulic cylinder 127.

When the inner corner form 26 is in its contracted position (FIGS. 1 and 4), the piston rod 129 is fully contracted within hydraulic cylinder 127, slide lugs 72' are positioned within slots 123 such that the rear walls 82' of bodies 74' are against the rear faces 145 of slots 123, and slide lugs 72 are positioned in slots 68 such that front walls 80 are engaged with the front faces 96 of slots 68. To move the inside corner form 26 from its contracted position to its expanded position, fluid actuator 106 is expanded. During the expansion, hydraulic cylinder 127 drives gusset 141 forward, which in turn moves skin plate member 32 and the two inner slide plates 128 in a forward direction (as indicated by arrow A). However, due to the loose (lengthwise) receipt of slide lugs 72 in slots 68, inner slide plates 28 slide relative to outer side slide plates 30. Nevertheless, the outer slide plates 30 and brackets 104 are moved outward (as indicated by arrow B) to accommodate the divergence of slide plates 28 as they are moved forward. The outward movement of brackets 104 causes the slide lugs 72' to slide outward in slots 123 in squaring arm 102. Moreover, this outward movement of brackets 104 further moves inner form members 24 outward. These sliding motions continue until the rear wall 82 of slide lugs 72 are engaged by rear face 98 of slot 68 and slide lug 72' engages the front face 147 of slot 123. At full expansion (FIGS. 2 and 4) of the inside corner form 26, the corner skin plate 32, molding face 50, molding face 62, inside skin plate 64 and inner form members 24 are all aligned to form a substantially smooth surface.

When the inner corner form is to be moved from its expanded position to its retracted position (such as, when after the concrete has set), the fluid actuator 106 is contracted. The rearward movement of hydraulic cylinder 127 pulls gusset 141, skin plate member 32, and the two inner slide plates 28 in a rearward direction (indicated by arrow C). Due to the loose (lengthwise) receipt of slide lug 72 in slots 68, relative sliding movement exists between slide plates 28 and 30. This relative sliding movement continues until the front wall 96 of slot 68 engages the front wall 80 of slide lug 72 at the fully retracted position. Additionally, as the inner slide plates 28 are moved rearwardly, the outer slide plates 30, brackets 104 and inner form members 24 are caused to move inwardly (indicated by arrow D). These movements continue until the actuator 106 is fully contracted and the entire inner mold 12 has pulled away from the concrete structure.

As is known in the prior art, the brackets 104 are secured to securing plates 149 which are bolted to complementary securing plates 151 of a framework mounting the internal form members 24. Hence, as discussed above, movement of the brackets 104 additionally causes movement of the internal form members 24.

Internal corner form 26 further includes a lubrication system 153 (FIGS. 2, 5 and 6) which functions to lessen the resistance which may be created between the relative sliding members 28, 30 and 102, 104, and to prevent grout (i.e., a cementitious mixture of excess water, cement, sand, etc.) from seeping in between the slide plates 28, 30. In particular, the slide plates 28, 30 are typically quite long and include a substantial amount of engaged surface area to be overcome when the form is expanded and contracted.

The lubrication system 153 (FIGS. 2, 5 and 6) is defined by a number of channels dispersed throughout the inside corner form 26. In particular, the external wall 40 of inner slide plate 28 is provided with an elongated vertical channel 155 extending the entire length of the inner slide plate 28, and a plurality of branch channels 157 which interconnect slots 68 with vertical channel 155. Each branch channel 157 at slot 68 is aligned with a peripheral channel 159 which extends around the entire perimeter of body 74 of slide lug 72. A medial passage 161 extends transversely entirely through body 74 and has a pair of opposite ends which open in peripheral channel 159. Medial passage 161 interconnects a longitudinal outlet passage 163 which is oriented substantially perpendicular to medial passage 163 and defines only one opening through head plate 76. The opening at head plate 76 is preferably tapped to facilitate the pressurized injection of grease into the lubrication system or to receive a plug. The lubrication system 153 further includes a number of bores 165 which extend transversely through inner slide plate 28 and intersect vertical channel 155. The intersection of bores 165 with vertical channel 155 are preferably adjacent the intersection of branch channels 157 with vertical channel 155; although any placement and number of bores 165 may be provided. Bores 165 are provided for the injection of grease into the lubrication system, as outlined below, and are therefore preferably tapped.

A lid passage 167 is formed in a lid grease bar 169. The lid grease bar 169 underlies lid 171 which covers the opening defined within internal form 12. Although not shown completely, lid grease bar 169 extends around the entire perimeter of the internal form 12. Further, spaced apart openings 172 are provided in the lid bar 169 for the pressurized insertion of the grease.

Once the mold has been assembled and the internal form 12 is still in its contracted position, grease or other flowable material is injected under pressure into the lubrication system 153. A wide variety of greases may be utilized, such as Kendall L69. The grease is injected through bores 165, 163 which are preferably threaded for this purpose, and through grease fittings 172 provided in lid bar 169. The pressurized grease would flow through vertical channels 155, peripheral channels 159, 159' branch channels 157, and lid passage 167.

A line of grease is provided long the entire length between the slide plates 28, 30 by the vertical channel 155. Further, the engagement of the slide plates and the slide lug is lubricated as well via branch channels 157 and peripheral channel 159. Once the lubrication is completed, fluid operator 106 is actuated to expand the inside corner form 26 and thereby move inner slide plate 28 forwardly relative to outer slide plate 30. This relative movement causes the line of grease formed in channel 155 to be smeared over the forward surface of these two plates 28, 30, to form an effective seal against the inward seepage of grout during the pouring of the concrete. Similarly, the line of grease formed along channel 167 between lid 171 and lid bar 169 also acts as a barrier to prevent the seepage of grout into the joint. The preclusion of the grout greatly alleviates the necessary cleaning of the form from casting to casting.

Grease may also be injected through slide lugs 72' to lubricate the engagement between brackets 104 and squaring arm 102. Specifically, the grease is injected into outlet passage 163 under pressure so that the grease passes through outlet passage 163, through medial passage 161, and around peripheral channel 159. This line of grease eases the sliding movement of these elements.

The lid 171 (FIGS. 1 and 8) is further mounted to a top plate 173 of the framework supporting the internal forming panels 24. Specifically, the slide lugs 72'' (which are identical to slide lugs 72) extend through spaced apart slots 175 defined in top plates 173. Slots 175 are dimensioned to matingly receive the body of the slide lug in a width direction, but to loosely receive the body of the slide lug in the length direction. This construction permits a limited sliding motion between the lid 171 and the top plates 173 of the internal panel framework. Further, body 74'' is inserted upwardly through slot 175 in top plate 173 such that the underside marginal edge of head plate 76' engages against the under surface 177 of top plate 173. Slide lug 72'' is provided with a pair of lateral holes 179 for receiving pins 181 therethrough, which are inserted to hold the slide lug in place for attachment of the lid. Lid 171 includes a plurality of bores 183 which are aligned with the tapped holes 88'' in the slide lug 72'' for securing lid 171 to side lug 72''. In this instance, a lug retainer 73 is not used.

The above description is that of a preferred embodiment of the invention. Various alterations and changes can be made without departing from the spirit and broader aspects of the invention as set forth in the appended claims.

I claim:

1. An inside corner form comprising:

a central corner member including a forming member for forming and shaping the inside corner of a concrete casting and a plurality of first slide plates secured thereto, each first slide plate defining an outer face and a first slot, each said first slot including a pair of planar opposing side faces, a front face and a rear face, said side faces of said first slot being parallel to one another;

a plurality of side members each including a second slide plate defining a second slot, each said second slot including a pair of opposing planar side faces, a front face and a rear face, said side faces of said second slot being parallel to one another, each said second plate being slidably engaged with the outer face of one of said first slide plates and positioned thereagainst such that the first and second slots of the engaged first and second slide plates are aligned with each other;

a plurality of slide lugs each defining a pair of planar, parallel side walls, each said slide lug being received into one of said aligned pair of first and second slots such that said side walls of each said slide lug matingly engage the side faces of said aligned first and second slots into which it is received to thereby prevent undesired shifting of said central corner member and said side members with respect to each other, each said slide lug further abuttingly engaging the front and rear faces of only one of said first and second slots to fix the slide lug with respect to said one of said first and second slots and permit limited sliding movement of the slide lug with respect to the other of said first and second slots and between the engaged first and second slide plates; and an actuator coupled with said central corner member to reciprocate said central corner member between an expanded position for forming the concrete casting and a retracted release position, said reciprocation of said central corner member being guided and controlled by the limited sliding movement permitted by the slide lugs.

2. An inside corner form as defined in claim 1, in which said side members each include a forming panel which aligns with said forming member in said expanded position to form a substantially smooth side wall adjacent the formed inside corner.

3. An inside corner form as defined in claim 2, wherein said first slide plates are oriented to diverge relative to one another as they extend away from said forming member, and wherein said side members are moved away from one another as said central corner member is moved toward its expanded position.

4. An inside corner form as defined in claim 3, further including a rear base member slidably secured to each side member and connected to said actuator to facilitate the driving reciprocation of said central corner member.

5. An inside corner form as defined in claim 4, in which said rear member includes a pair of third slots each defining a pair of opposing planar side faces, a front face and a rear face, said side faces of said third slot being parallel to one another; in which each said side member includes a bracket secured to the second slide plate, wherein each said bracket includes a fourth slot defining a pair of opposite planar side faces, a front face and a rear face, said side faces of said fourth slot being parallel to one another, and wherein each said bracket slidably engages said rear member such that each said fourth slot is substantially aligned with one of said third slots; and in which said inside corner form further includes a plurality of additional slide lugs each defining a pair of spaced apart planar, parallel side walls, wherein each said additional slide lug is received into one of said aligned pair of third and fourth slots such that said side walls of said additional slide lugs matingly engage the sides of said third and fourth slots into which it is received to thereby prevent undesired shifting of said rear member and said brackets, each said slide lug further abuttingly engaging the front and rear faces of only one of said third and fourth slots to fix the additional slide lug with respect to one of said third and fourth slots and permit limited sliding movement of the additional slide lug with respect to the other slot and between said brackets and said rear member.

6. An inside corner form as defined in claim 5, in which said actuator is a fluid operator having a cylinder and a reciprocating piston.

7. An inside corner form as defined in claim 1, which further includes a lubrication system having a main channel formed in each of said outer faces of said first slide plates and a quantity of flowable material injected into said main channel to lubricate the engagement between the engaged first and second slide plates.

8. An inside corner form as defined in claim 7, in which said main channel is formed near said forming member so that said flowable material forms a barrier to the seepage of grout into the inside corner form during the casting of the concrete.

9. An inside corner form as defined in claim 1, further including a barrier of flowable material provided between the engaged first and second slide plates to prevent the seepage of grout into the inside corner form during the concrete casting process.

10. An inside corner form comprising:

a central corner member including a forming member for forming and shaping the inside corner of a concrete casting and a plurality of first slide plates secured thereto, each first slide plate defining an outer face and a first slot, each said first slot including a pair of opposing planar faces, a front face and a rear face, said side faces of said first slot being parallel to one another;

a plurality of side members each including a second slide plate defining a second slot, each said second slot including a pair of opposing planar faces, a front face and a rear face, said side faces of said second slot being parallel to one another, each said second plate being slidably engaged with the outer face of one of said first slide plates and positioned thereagainst such that the first and second slots of the engaged first and second slide plates are aligned with each other;

a plurality of slide lugs each defining a pair of planar, parallel side walls, each said slide lug being received into one of said aligned pair of first and second slots such that said side walls of each said slide lug matingly engage the side faces of said aligned first and second slots into which it is received to thereby prevent undesired shifting of said central corner member and said side members with respect to each other, each said slide lug further abuttingly engaging the front and rear faces of only one of said first and second slots to fix the slide lug with respect to said one of said first and second slots and permit limited sliding movement of the slide lug with respect to the other of said first and second slots and between the engaged first and second slide plates; and an actuator coupled with said central corner member to reciprocate said central corner member between an expanded position for forming the concrete casting and a retracted release position, said reciprocation of said central corner member being guided and controlled by the limited sliding movement permitted by the slide lugs;

a lubrication system having a main channel formed in each of said outer faces of said first slide plates and a quantity of flowable material injected into said main channel to lubricate the engagement between the engaged first and second slide plates, said lubrication system also having a peripheral channel defined around the perimeter of each said slide lug and a quantity of flowable material injected into said peripheral channel to lubricate the engagement between the first and second slide plates and the corresponding slide lug received in the slots thereof.

11. An inside corner form as defined in claim 10, in which said lubrication system further includes a connecting channel defined in said outer face of each said first slide plate and oriented to interconnect said main channel and said peripheral channel.

12. An inside corner form as defined in claim 11, in which said lubrication system further includes at least one aperture extending through each said first slide plate and an outlet passage defined in each said slide lug, wherein said aperture interconnects said main channel and includes an opening for injecting flowable material therein.

13. An inside corner form for forming an inside corner of a wall structure for a concrete casting comprising:

a corner plate adapted to form the inside corner of the concrete casting;

a pair of diverging inner slide plates fixedly secured to opposite sides of said corner plate, each said inner slide plate defining an outer face and a first slot having a first height dimension and a first length dimension, said first height dimension being defined by a pair of planar, parallel sidewalls;

a pair of diverging outer slide plates each defining an inner face placed in contiguous engagement with said outer face of one of said inner slide plates and a second slot having a second height dimension and a second length dimension, said second height dimension being defined by a pair of planar, parallel sidewalls, said second height dimension being the same as said first height dimension and in alignment therewith, and said second length dimension being different than said first length dimension;

a forming plate fixed to each outer slide plate for forming a portion of a wall structure adjacent the corner, said forming plates being substantially aligned with said corner plate at a selected position;

a plurality of brackets, at least one of said brackets being secured to each of said second slide plates, each said bracket including a third slot having a third height dimension and a third length dimension, said third height dimension being defined by a pair of planar, parallel sidewalls, said third height dimension being equal to said first height dimension, and said third length dimension being substantially equal to one of said first and second length dimensions;

at least one base member slidably coupled to a pair of brackets and defining a pair of fourth slots, each said fourth slot having a fourth height dimension and a fourth length dimension, said fourth height dimension being defined by a pair of planar, parallel sidewalls, said fourth height dimension being substantially equal to said first height dimension and said fourth length dimension being substantially equal to one of said first and second length dimensions but being different than said third length dimension, said base member being oriented with respect to said engaged brackets such that each of said fourth slots of said base member are aligned with said one of said third slots of said brackets;

a plurality of slide lugs, each said slide lug having a pair of opposite planar side walls parallel with one another and a pair of opposite end walls, said side walls being spaced apart a distance equal to said first height dimension of said first slot, said end walls being spaced apart a distance substantially equal to the smaller of said first and second length dimensions of said first and second slots, one of said slide lugs being closely received in each of said aligned first and second slots and each of said aligned third and fourth slots for preventing undesirable shifting of said slide plates, said corner plate and said forming plates while permitting relative sliding movement between said sliding plates only in directions corresponding to the lengths of the corresponding first and second slots and between said rear member and said brackets only in directions corresponding to the lengths of said third and fourth slots; and an actuator coupled between said base member and said corner plate to expand and contract said inside corner form.

14. An inside corner form as defined in claim 13, in which said actuator is a fluid operator having a cylinder and a reciprocating piston.

15. An inside corner form as defined in claim 13, which further includes a lubrication system having a main channel formed in each of said outer faces of said first slide plates and a quantity of flowable material injected into said main channel to lubricate the engagement between the engaged first and second slide plates.

16. An inside corner form as defined in claim 15, in which said main channel is formed near said forming member so that said flowable material forms a barrier to the seepage of grout into the inside corner form during the casting of the concrete.

17. An inside corner form as defined in claim 16, in which said lubrication system further includes a peripheral channel defined around the perimeter of each said slide lug and a quantity of flowable material injected into said peripheral channel to lubricate the engagement between the first and second slide plates and the corresponding slide lug received in the slots thereof.

18. An inside corner form as defined in claim 17, in which said lubrication system further includes a connecting channel defined in said outer face of each said first slide plate and oriented to interconnect said main channel and said peripheral channel.

19. An inside corner form as defined in claim 18, in which said lubrication system further includes at least one aperture extending through each said first slide plate and an outlet passage defined in each said slide lug, wherein said aperture interconnects said main channel and includes an opening for injecting therein the flowable material.

20. An inside corner form as defined in claim 13, further including a barrier of flowable material provided between the engaged first and second slide plates to prevent the seepage of grout into the inside corner form during the concrete casting process.

21. An inside corner form as defined in claim 13, which further includes a plurality of spaced apart pairs of brackets attached to said outer slide plates, a plurality of spaced apart base members wherein one base member engages each pair of brackets, and a plurality of actuators wherein one actuator engages each base member and at an opposed location thereto on said corner plate.

22. An inside corner form for forming an inside corner of a cast wall structure, said inside corner form comprising:

a central member having a corner forming member and a plurality of first diverging sidewalls, each of said first diverging sidewalls defining a first opening having a pair of parallel spaced apart planar sides, said corner forming member being provided to define wall portions of the inside corner;

a pair of side members each having a wall forming member and a second sidewall, each said wall forming member being provided to define wall portions of the wall structure adjacent the inside corner, and each of said second sidewalls being slidably engaged against one of said first sidewalls, each of said second sidewalls defining a second opening having a pair of parallel spaced apart planar sides;

an actuator for moving said central member and said side members so that said central and side members and their corresponding corner and wall forming members are reciprocally moved between an expanded casting position and a retracted release position; and a plurality of slide lugs each including a pair of parallel faces, each said slide lug being received into one of said first and second openings with said parallel faces matingly engaging said planar sides of said first and second openings such that said first and second sidewalls are each maintained in a fixed orientation with respect to one another except for a linear sliding motion between each engaged side member and said corner member, said relative sliding motion being parallel to said planar sides of first and second spaced apart openings, so that said corner forming member and said wall forming members are prevented from undesirable shifting and are properly aligned and positioned in the expanded casting position to form a relatively smooth inside corner wall structure.

23. An inside corner form as defined in claim 22, which further includes a rear member slidably coupled to each of said side members, and in which said side members are engaged to said rear member such that said side members are each maintained in a fixed orientation with respect to said rear member except for a linear sliding motion therebetween during said reciprocal motion, so that said corner forming member and said wall forming members are properly aligned and positioned in the expanded casting position to form a relatively smooth inside corner wall structure.

24. An inside corner form as defined in claim 23, which further includes a quantity of flowable material positioned between said first and second sidewalls to form a barrier so that grout from the casting of the wall structure is prevented from seeping between said sidewalls.

25. An inside corner form as defined in claim 23 further comprising a plurality of structures each of which is connected with one of said rear member and said side members such that no relative movement exists therebetween during said reciprocal movement, and each of which is connected with the other of said rear member and said side members such that only a linear sliding motion exists therebetween during said reciprocal movement.

26. An inside corner form as defined in claim 25, in which each said coupling structure is comprised of a second slide lug member having a pair of planar faces and a pair of end walls, said inside corner form further comprises a pair of openings defined in said rear member and an opening in each said side member such that said openings defined in said one of said rear member and said side members are dimensioned to matingly receive said planar faces and said end walls of said slide lug and the other of said openings defined in the other of said rear member and side members matingly receives said planar faces of said slide lug for linear sliding movement therewith.

27. An inside corner form as defined in claim 22, which further includes a rear member slidably coupled to each of said side members, and in which said aligning assembly engages said side members and said rear member such that said side members are each maintained in a fixed orientation with respect to said rear member except for a linear sliding motion therebetween during said reciprocal motion, so that said corner forming member and said wall forming members are properly aligned and positioned in the expanded casting position to form a relatively smooth inside corner wall structure.

28. An inside corner form as defined in claim 22, which further includes a quantity of flowable material positioned between said first and second sidewalls to form a barrier so that grout from the casting of the wall structure is prevented from seeping between said sidewalls.

29. An inside corner form as defined in claim 28, in which said flowable material has a high viscosity.

30. An inside corner form as defined in claim 23, in which said flowable material is grease.

31. An inside form for casting a tubular concrete structure, said form comprising:

a pair of forming panels defining all of the inside surface of the tubular structure but two opposing corner portions thereof; and one inside corner form positioned in each of said two opposing corner portions and connecting said forming panels together for expansion and contraction of the inside form, each inside corner form comprising:

a central corner member including a forming member for forming and shaping the inside corner of a concrete casting and a plurality of first slide plates secured thereto, each first slide plate defining an outer face and a first slot, each said first slot including a pair of opposing planar side faces, a front face, and a rear face said side faces of said first slot being parallel to one another;

a plurality of side members each including a second slide plate defining a second slot, each said second slot including a pair of opposing planar side faces, a front face, and a rear face, said side faces of said second slot being parallel to one another, each said second plate being slidably engaged with the outer face of one of said first side plates and positioned thereagainst such that the first and second slots of the engaged first and second slide plates are aligned with each other;

a plurality of slide lugs each defining a pair of planar, parallel side walls, each said slide lug being received into one of said aligned pair of first and second slots such that said side walls of each said slide lug matingly engage the side faces of said aligned first and second slots into which it is received to thereby prevent undesired shifting of said central corner member and said side members with respect to each other, each said slide lug further abuttingly engaging the front and rear faces of only one of said first and second slots to fix the slide lug with respect to said one of said first and second slots and permit limited sliding movement of the slide lug with respect to the other of said first and second slot and between the engaged first and second slide plates; and an actuator coupled with said central corner member to reciprocate said central corner member between an expanded position for forming the concrete casting and a retracted release position, said reciprocation of said central corner member being guided and controlled by the limited sliding movement permitted by the slide lugs.

32. An inside form as defined in claim 31, wherein said first slots each define a height and length, wherein said second slots each define a height substantially equal to the height of said first slot and a length which is different than said length of said first slot, and wherein said side walls of said plurality of said slide lugs are spaced apart a distance equal to said heights of said first and second slots.

33. An inside form as defined in claim 32, in which each said actuator is a fluid operator having a cylinder and a reciprocating piston.

34. An inside form as defined in claim 32, which further includes a lid, which overlies and substantially covers said forming panels and said inside corner forms, and a plurality of additional slide lugs which define a pair of additional sidewalls and a pair of additional end walls and which are substantially the same as said slide lugs of said inside corner forms, wherein said additional slide lugs are fixed to said lid at spaced apart locations, and wherein said forming panels include a framework defining a plurality of slots having one dimension which matingly receives said additional side walls and a second dimension transverse to the first which is larger than a distance that said additional end walls are spaced apart so that said forming members can slide relative to said lid during the expansion and contraction of the inside form.

35. An inside form as defined in claim 31, in which said inside corner forms each further include a lubrication system having a main channel formed in each of said outer faces of said first slide plates and a quantity of flowable material injected into said main channel to lubricate the engagement between said first and second slide plates.

36. An inside form as defined in claim 35, in which each said main channel is formed near said forming member so that said flowable material forms a barrier to the seepage of grout into the inside corner forms during the casting of the concrete.

37. An inside form as defined in claim 36, in which said lubrication system of each said inside corner form further includes a peripheral channel defined around the perimeter of each said slide lug and a quantity of flowable material injected into said peripheral channel to lubricate the engagement between said first and second slide plates and the corresponding slide lug received in the slots thereof.

38. An inside form as defined in claim 37, in which said lubrication system of each inside corner form further includes a connecting channel defined in said outer face of said first slide plates and oriented to interconnect said main channel and said peripheral channel.

39. An inside form as defined in claim 38, in which said lubrication system of each said inside corner form further includes at least one aperture extending therethrough and an outlet passage defined in each said slide lug, wherein said aperture interconnects said main channel and includes an opening for injecting flowable material therein.

40. An inside form as defined in claim 31, in which each said inside corner form further includes a barrier of flowable material provided between the engaged first and second slide plates to prevent the seepage of grout into the inside corner forms during the concrete casting process.

41. An inside form as defined in claim 31, further including a lid which overlies and substantially covers said forming members and said inside corner forms, a lid bar extending substantially around the entire perimeter of said inside form, and a quantity of flowable material positioned between said lid bar and said lid for lubrication thereof and for forming a seal against grout seepage therethrough.

42. An inside corner form for forming an inside corner of a wall structure for a concrete casting, said inside corner form comprising:

a central member having a corner portion for defining a corner of a cast wall structure and a pair of diverging sidewalls;

a pair of side members, one of said side members being positioned to each side of said central member, each side member having a side face placed in contiguous engagement with one of said sidewalls of said central member, each said side member further including a wall portion for defining a portion of the cast wall structure adjacent the corner;

a plurality of lugs, each said lug being immovably connected to one of said sidewalls of said central member and said side faces of said side members with each lug projecting outward toward the other one of said sidewalls and said side faces adjacent thereto, each of said lugs including a pair of opposite planar, parallel side surfaces and a pair of end surfaces;

said other one of said sidewalls and said side faces defining a plurality of openings each having a pair of sides defined by a pair of planar, parallel guide walls and a pair of end walls, each of said openings receiving therein one of said lugs, said guide walls of said opening matingly engaging said side surfaces of said received lug, said end walls of said opening being spaced apart a distance greater than said end surfaces of said received lug, said interconnection of said lugs and said openings permitting limited sliding movement between said central member and said side members and preventing said central member and said side members from shifting undesirably with respect to one another; and an actuator for moving said central member and said side members along said limited sliding movement between an expanded casting position and a retracted release position.

* * * * *